United States Patent [19]

Degner et al.

[11] 4,298,438

[45] Nov. 3, 1981

[54] PREPARATION OF 4-TERT.-BUTYLBENZALDEHYDE

[75] Inventors: Dieter Degner, Dannstadt-Schauernheim; Hardo Siegel, Speyer; Heinz Hannebaum, Ludwigshafen, all of Fed. Rep. of Germany

[73] Assignee: BASF Aktiengesellschaft, Rheinland-Pfalz, Fed. Rep. of Germany

[21] Appl. No.: 203,597

[22] Filed: Nov. 3, 1980

[30] Foreign Application Priority Data

Dec. 1, 1979 [DE] Fed. Rep. of Germany ..... 2948455

[51] Int. Cl.[3] ..... C25B 3/02

[52] U.S. Cl. ..... 204/78

[58] Field of Search ..... 204/78

[56] References Cited

U.S. PATENT DOCUMENTS 4,235,683 11/1980 Degner et al. ..... 204/78

*Primary Examiner*—R. L. Andrews

*Attorney, Agent, or Firm*—John H. Shurtleff

[57] ABSTRACT

A process for the preparation of 4-tert.-butylbenzaldehyde by electrochemical oxidation of 4-tert.-butyltoluene in the presence of an inorganic acid and of an alkylsulfonic, alkenylsulfonic or arylsulfonic acid.

4 Claims, No Drawings

PREPARATION OF 4-TERT.-BUTYLBENZALDEHYDE

The present invention relates to a process for the electrochemical preparation of 4-tert.-butylbenzaldehyde.

The electrosynthesis of substituted benzaldehydes by anodic and oxidation of the corresponding alkylbenzenes is described, for example, in Helv. Chim. Acta 9 (1926), 1097. In this process, the electrolysis is carried out in sulfuric acid solution. However, the benzaldehydes are produced in low yields, and are difficult to isolate from the multi-component mixture produced. U.S. Pat. No. 4,148,696 discloses that benzaldehydes may be prepared by electrochemical oxidation of the corresponding alkylaromatics if the electrolysis is carried out in the presence of a fatty acid or an alkali metal salt or alkaline earth metal salt thereof, and of a tetraalkylammonium salt. In this process, the nuclear-substituted and side chain-substituted fatty acid esters are however produced as by-products, together with the benzaldehydes. Furthermore, the material produced by electrolysis requires a plurality of separations. Thus, if the synthesis is carried out industrially, the fatty acids and fatty acid salts must be separated from the benzaldehydes and recycled, and the benzaldehydes then separated from the fatty acid esters.

We have found that 4-tert.-butylbenzaldehyde can be prepared substantially more advantageously by electrochemical oxidation of 4-tert.-butyltoluene in the presence of an inorganic acid, if the oxidation is carried out in the presence of an alkylsulfonic, alkenylsulfonic or arylsulfonic acid. The process according to the invention gives a high yield of 4-tert.-butylbenzaldehyde. A further substantial advantage of the novel process is that the mixture produced is simple to work up. Thus, after completion of electrolysis, the phases are separated and the 4-tert.-butylbenzaldehyde is isolated direct from the organic phase by distillation.

The novel process may be carried out batchwise or continuously. The electrolysis does not require any special cell. It can, for example, be carried out in the plate and frame cell commonly used in industry. The electrolyte consists of 4-tert.-butyltoluene and an aqueous solution of an inorganic acid, to which a small amount of an alkylsulfonic, alkenylsulfonic or arylsulfonic acid is added. The inorganic acid may be, for example, sulfuric acid. The sulfonic acid is preferably a long-chain alkylsulfonic acid or alkenylsulfonic acid, or an arylsulfonic acid, in which the aryl radical may be alkyl-substituted. For the purposes of the invention, a long-chain alkylsulfonic acid or alkenylsulfonic acid is of not less than 6 carbon atoms. Examples of suitable sulfonic acids are aliphatic sulfonic acids, eg. of the formulae $C_{14}H_{29}SO_3H$, $C_{16}H_{33}SO_3H$ and $C_{17}H_{35}SO_3H$, aliphatic-aromatic sulfonic acids, eg. benzenesulfonic acids, which may be ring-substituted by alkyl of the formula $C_{10-14}H_{21-29}$, and butylnaphthalenesulfonic acid. Mixtures of the sulfonic acids may also be employed.

An example of the composition of an electrolyte employed in the process is: 5–50% by weight of 4-tert.-butyltoluene, 0.5–10% by weight of sulfuric acid, 40–90% by weight of water and 0.05–50% by weight of sulfonic acid.

Examples of suitable anode materials are lead dioxide, and titanium coated with lead dioxide. Examples of suitable cathodes are lead, iron, steel and graphite electrodes. The electrolysis is carried out at a current density of from 1 to 10 A/dm$^2$ and at from 10° to 90° C. The conversion of 4-tert.-butyltoluene is preferably from 10 to 50%. The electrolysis product is preferably worked up by distillation, ie. the phases are separated and the organic phase is distilled under reduced pressure.

Unconverted 4-tert.-butyltoluene is recycled to the electrolysis.

4-tert.-Butylbenzaldehyde is a valuable intermediate for fungicides and for scents (lilial).

EXAMPLE

Apparatus: partitioned cell with cation exchange membrane
Anode: $PbO_2$
Anolyte:
300 g of 4-tert.-butyltoluene
1,200 g of 5% strength aqueous sulfuric acid
15 g of a 30% strength aqueous solution of $C_{15}H_{31}SO_3H$
Catholyte: 5% strength aqueous sulfuric acid
Cathode: Pb
Current density: 5 A/dm$^2$
Temperature: 30°–32° C.
Electrolysis with 3.3 F/mole of 4-tert.-butyltoluene During the electrolysis, the electrolyte is pumped over a heat exchanger. After completion of electrolysis, the phases are separated and the organic phase is fractionally distilled under 2 mm Hg at 60°–120° C. This gives 180 g of unconverted 4-tert.-butyltoluene and 92.4 g of 4-tert.-butylbenzaldehyde, corresponding to a yield of 70.4%.

We claim:

1. A process for the preparation of 4-tert.-butylbenzaldehyde by electrochemical oxidation of 4-tert.-butyltoluene in the presence of an inorganic acid, wherein the oxidation is carried out in the presence of an alkylsulfonic, alkenylsulfonic or arylsulfonic acid.

2. A process as claimed in claim 1, wherein the inorganic acid used is sulfuric acid.

3. A process as claimed in claim 1, wherein the sulfonic acid used is an aliphatic sulfonic acid of the formula $C_{14-17}H_{29-35}SO_3H$.

4. A process as claimed in claim 1, wherein the electrochemical oxidation is carried out with an electrolyte which contains 5–50% by weight of 4-tert.-butyltoluene, 0.5–10% by weight of sulfuric acid, 40–90% by weight of water and 0.05–5% by weight of sulfonic acid.

* * * * *